US005605470A

United States Patent [19]

Braithwaite et al.

[11] Patent Number: 5,605,470

[45] Date of Patent: Feb. 25, 1997

[54] DETONATOR HARNESS UNIT AND A METHOD OF MAKING THE SAME

[75] Inventors: Jim Braithwaite, St. Albans; Gary Langridge, Monks Gate, both of England

[73] Assignee: The Whitaker Corporation, Wilmington, Del.

[21] Appl. No.: 371,913

[22] Filed: Jan. 12, 1995

[51] Int. Cl.[6] ..... H01R 13/00; H01R 4/24

[52] U.S. Cl. ..... 439/417; 439/404

[58] Field of Search ..... 439/417, 404, 439/405, 497

[56] References Cited

U.S. PATENT DOCUMENTS

| | | | |
|---|---|---|---|
| 3,668,301 | 6/1972 | Faulconer | 174/88 R |
| 4,127,312 | 11/1978 | Fleischhacker et al. | 339/99 R |
| 4,262,985 | 4/1981 | Muehlhausen, II | 439/404 |
| 4,270,831 | 6/1981 | Takahashi | 339/99 R |
| 4,431,248 | 2/1984 | Huntley et al. | 439/405 |
| 4,484,791 | 11/1984 | Johnson | 439/404 |
| 4,701,139 | 10/1987 | Good et al. | 439/497 |
| 5,064,382 | 11/1991 | Minnis | 439/395 |
| 5,125,850 | 6/1992 | Locati | 439/404 |

FOREIGN PATENT DOCUMENTS

| | | |
|---|---|---|
| 1223430 | 2/1971 | United Kingdom . |
| 1497629 | 1/1978 | United Kingdom . |
| 2236437 | 4/1991 | United Kingdom . |
| 2243500 | 10/1991 | United Kingdom . |
| 2268004 | 12/1993 | United Kingdom . |
| 2273005 | 6/1994 | United Kingdom . |

*Primary Examiner*—Paul T. Sewell
*Assistant Examiner*—Luan K. Bui
*Attorney, Agent, or Firm*—Eric J. Groen; Driscoll A. Nina

[57] ABSTRACT

An electrical connector assembly is comprised of a first housing portion having an upper cover portion. A lower housing portion has a corresponding cover portion. Terminals having insulation displacement slots at each end thereof are positioned in slots of the lower housing portions. The upper housing portion has a cable receiving channel at cooperating with a channel in the upper cover portion to align the conductors with apertures in the lower housing portion. The cable can be positioned in a channel of the lower cover portion and the entire assembly can be pressed together by way of the upper and lower lids.

9 Claims, 5 Drawing Sheets

DETONATOR HARNESS UNIT AND A METHOD OF MAKING THE SAME

BACKGROUND OF THE INVENTION

Field of the Invention

This invention relates to a detonator harness unit for use in providing a detonator harness in combination with other such units, and to a method of making a detonator harness unit.

Harnesses for supplying activating voltage to an array of detonators received in respective bores in a working face of a mine, for example, a gold mine, the bores receiving explosive charges, are, when stored in the mine, for subsequent use, subject to damage by the ingress of moisture. The present invention is intended to provide a detonator harness unit which can be stored with impunity in a damp environment.

SUMMARY OF THE INVENTION

According to one aspect of the invention, a detonator harness unit comprises first and second mating electrical connectors and a detonator from which extends a length of a cable having conductors for the supply of activating voltage to the detonator, an end portion of the cable being received in the first connector in sealing tight fashion and a portion of the cable intermediate the detonator and the first connector being received in the second connector in sealing tight fashion, the connectors being matable in sealing tight fashion electrically to connect respective conductors of the end portion of the cable with respective conductors of the intermediate portion of the cable.

For the storage, in a mine, of such a detonator harness unit, the two connectors thereof are mated in sealing relationship, so that the unit is sealed against the ingress of moisture. In use, with the detonators in situ in their respective bores, the first connector of each detonator harness unit, is unmated from the second connector thereof and is mated with a respective second connector of the next adjacent unit, whereby a complete harness for all of the detonators is provided.

According to a preferred embodiment of the invention, each connector comprises a lid and a housing, the cable being sandwiched between the lid and the housing of each of the two connectors, the lid and the housing of each connector defining an annular channel, through which the cable passes, and a grease seal being provided in the channel. The electrical connections between the conductors of the two portions of the cable may be effected by means of electrical terminals provided either in one of the housings or in both of the housings. The terminals may be double ended insulation displacement terminals.

According to another aspect of the invention, a method of making a detonator harness unit comprises the steps of, supporting a length of detonator supply cable having conductors for supplying a detonator with activating voltage, applying a first electrical connector to one end portion of the cable, applying a second electrical connector to an intermediate portion of the cable, stuffing the other end portion of the cable into a detonator, sealing each connector to the cable, and mating the connectors in sealing tight relationship, electrically to connect the respective conductors of the end, and the intermediate, portions of the cable. The step of sealing each connector to the cable, is carried out, according to a preferred embodiment of the invention, by injecting a grease sealing material into a cavity in the connector, through which cavity cable passes.

DETAILED DESCRIPTION OF THE PREFERRED EMBODIMENT

Figure 1:
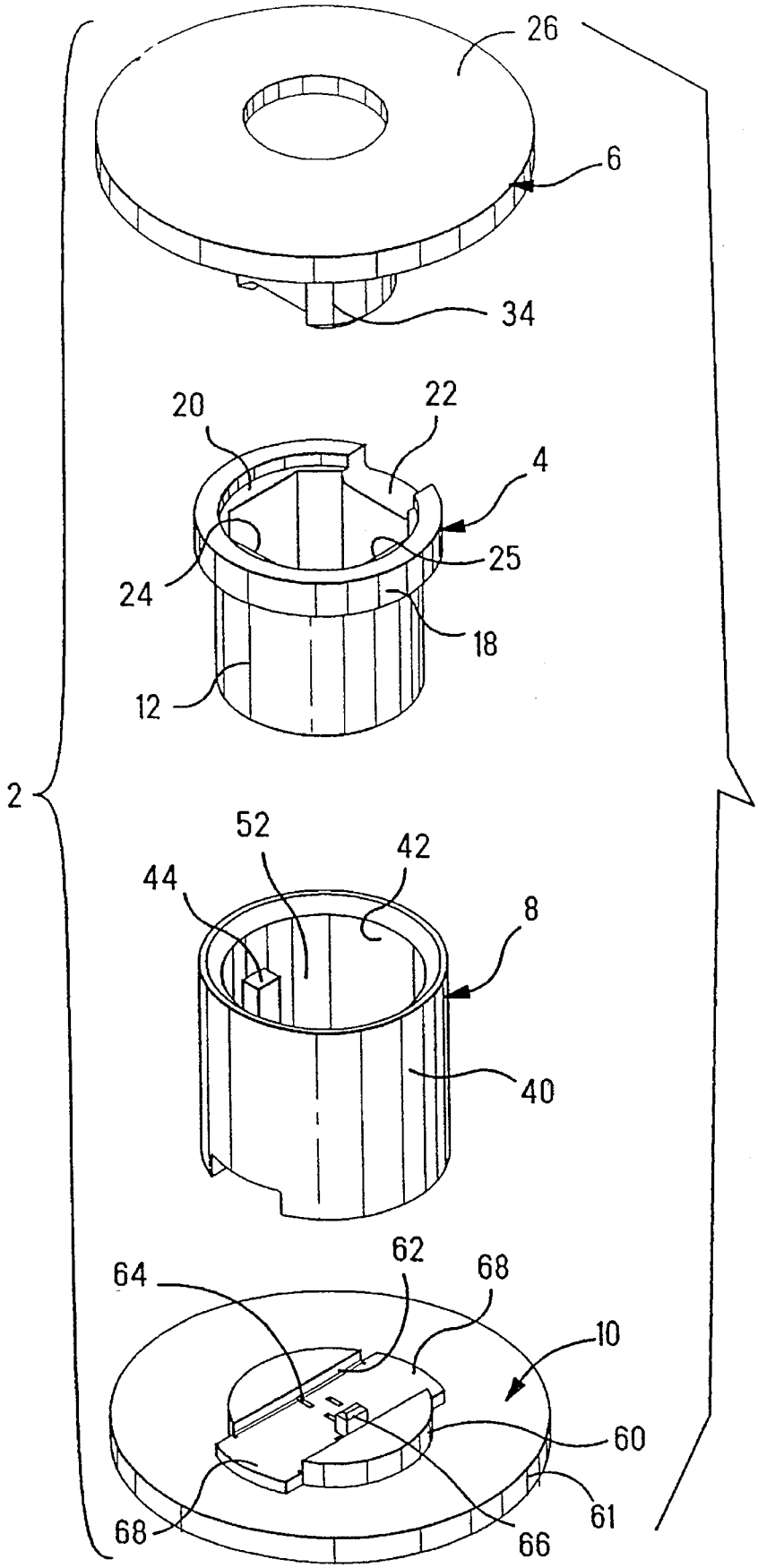
FIG. 1 is an isometric view of the connector components.
Figure 2:
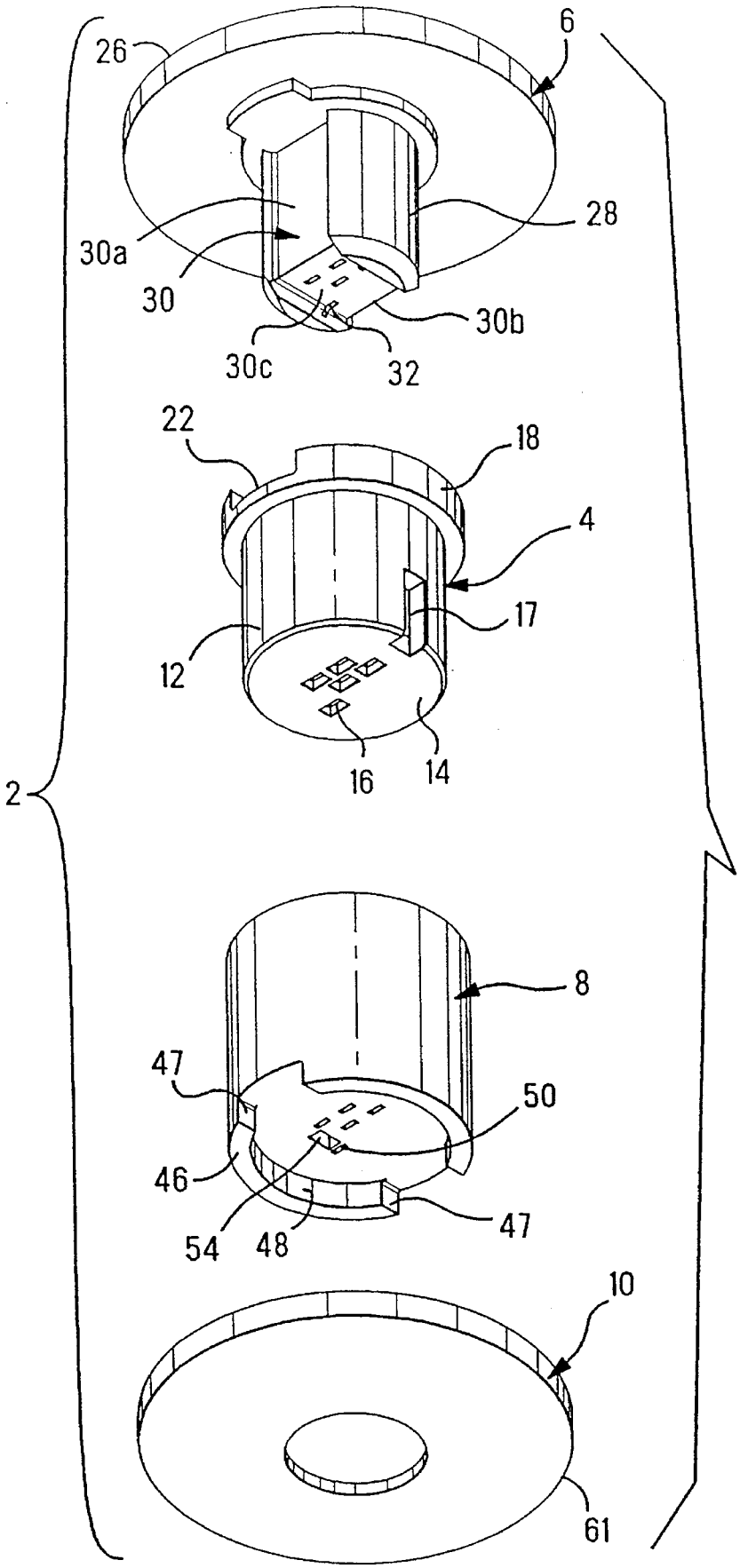
FIG. 2 is an isometric view of the components shown in FIG. 1 from a lower perspective.

With respect first to FIG. 1, the connector assembly is represented by the reference numeral 2, where the assembly is comprised of an upper connector housing portion 4 having a corresponding cover 6, the connector 4 being intermatable with corresponding lower connector housing 8 having a cover portion 10. As best shown in FIGS. 1 and 2, the housing portion 4 includes an outer peripheral surface 12 having a front face at 14 having a plurality of terminal receiving apertures 16. The outer peripheral surface 12 includes a polarizing notch at 17, for the correct positioning of the housing 4 with its corresponding housing 8 as will be described herein. The connector housing 4 further includes an upper cylindrical flange 18 forming a rim around the upper surface 20 of the housing where the rim is interrupted at 22 to provide a cable access channel therethrough. The housing 4 has a bore 24 therethrough having one cylindrical surface 25 for correctly positioning the upper cap 6.

With reference now to FIG. 2, the upper cover portion 6 includes a lid portion 26 having a pressing block 28 extending therefrom. The pressing block includes a cable receiving channel 30 having a portion **30*a* on one side of the block, a portion 30*b* on the opposite side of the block, and a lower channel portion 30*c* at the lower face of the block. The face 30*c* is formed with terminal receiving slots 32, which do not house terminals, but allow passage therethrough as will be described herein. As shown best in FIG. 1, the upper cover portion 6 includes a cylindrical surface at 34 which is profiled for receipt against the cylindrical inner surface 25 for correctly positioning the cover portion 6 with the lower housing portion 4**.

With respect to FIGS. 1 and 2, the lower housing portion 8 includes a cylindrical shell 40 having an inner cylindrical surface at 42, where the inner surface 42 carries a polarizing lug at 44 for aligning with the slot 16 (FIG. 2). As shown in FIG. 2, the lower housing 8 further includes a lower rim at 46 projected away from a lower surface 48 of the housing portion 8. The lower surface 48 has a plurality of apertures at 50 which house terminals, such as those shown in FIG. 7, where one insulation displacement portion extends below surface 48 of the housing 8, and one insulation displacement portion extends above an upper surface 52 (FIG. 1) of the housing portion 8. The lower surface 48 of the housing 8 is also provided with a polarizing aperture at 54.

As shown now in FIG. 1, the lower cover part 10 is generally circular in configuration having a cylindrical platform 60 provided in the centre thereof. The platform 60 is provided with a through channel at 62 which is profiled to receive a cable to be terminated. The channel is provided with terminal receiving slots at 64 and a polarizing peg at 66 which corresponds to the aperture at 54 in the lower housing portion 8. It should be appreciated that the lower rim portion 46 of the lower housing portion 8 is profiled to be received over the cylindrical platform 60, with the through channels 47 aligned with step portions 68 extending from the channel 62.

Figure 7:
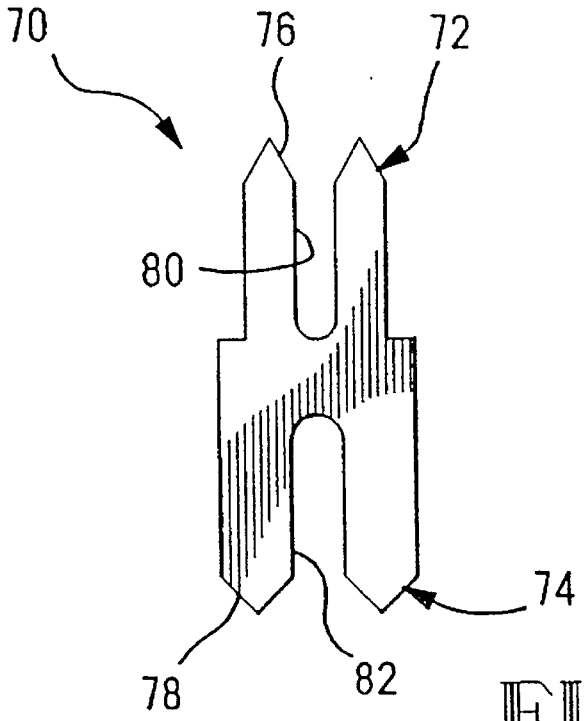
FIGS. 7 and 8 show front plan views of possible terminals for use with the connector shown in FIGS. 1–6.
Figure 8:
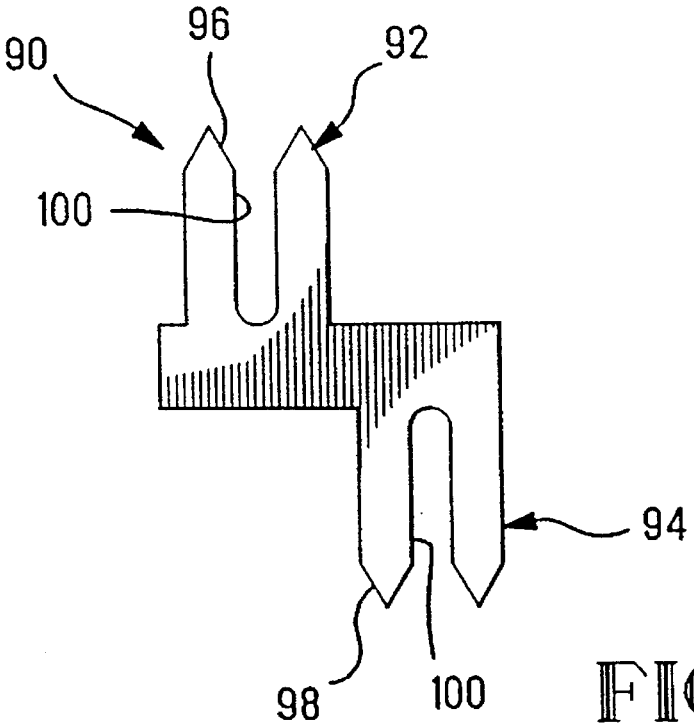

With reference now to FIG. 7, an electrical terminal is shown generally at 70 having two insulation displacement slot portions 72 and 74 extending from opposite ends. These type of terminals are generally known in the art and include insulation piercing portions 76 and 78 and wire receiving slot portions 80 and 82 to receive the bared conductor in electrical engagement. Another terminal shown in FIG. 8 as 90 has staggered electrical terminals 92 and 94 including insulation severing portions 96 and 98 and slot portions 100 and 102. The staggered terminal shown in FIG. 8 is sometimes used to electrically interconnect an electrical conductor in one cable with a conductor in another cable which is laterally staggered from the first conductor.

Figure 4:
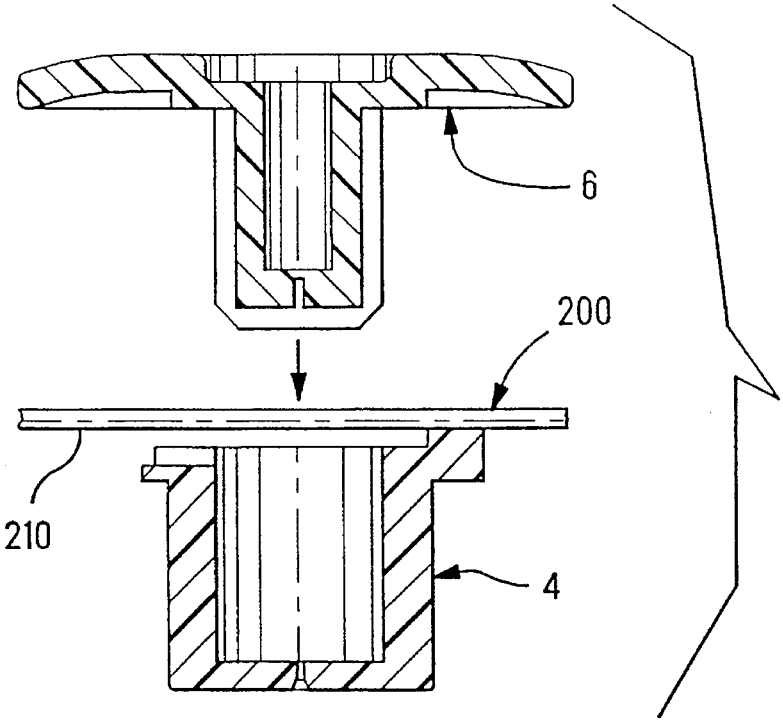
FIGS. 4–6 show diagrammatical views of the loading of the cable into the upper connector half with its corresponding cover.
Figure 5:
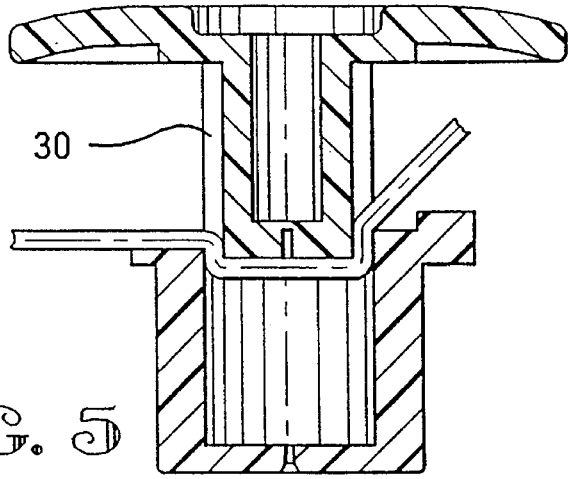
Figure 6:
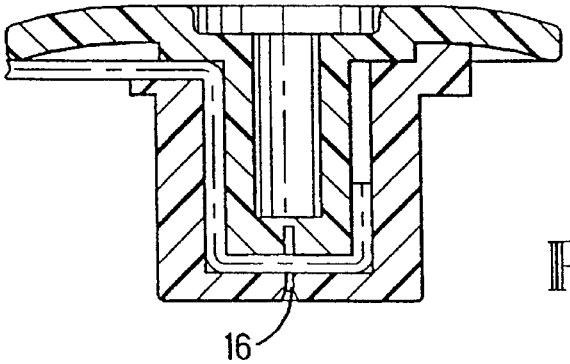

With the connector elements as described above, the connector assembly 2 is assembled as follows. The end of the cable shown as 200*a* is positioned in the channel 22 of the housing portion 4 with the cable extending over the rim portion 18. As shown in FIGS. 4–6, the movement of the upper cover portion 6 downwardly into the lower housing portion 4 pushes the cable 200 into the opening 25 and positions the cable around the channel portions 30*a*–30*c* as shown in FIG. 6. The cable is held fixed at position 210 while the cover 6 is being assembled to the housing portion 4. As shown in FIG. 6, as the housing portion 4 and cover portion 6 are finally assembled, the individual conductors are aligned with the slots 16 in the housing portion 4.

Figure 3:
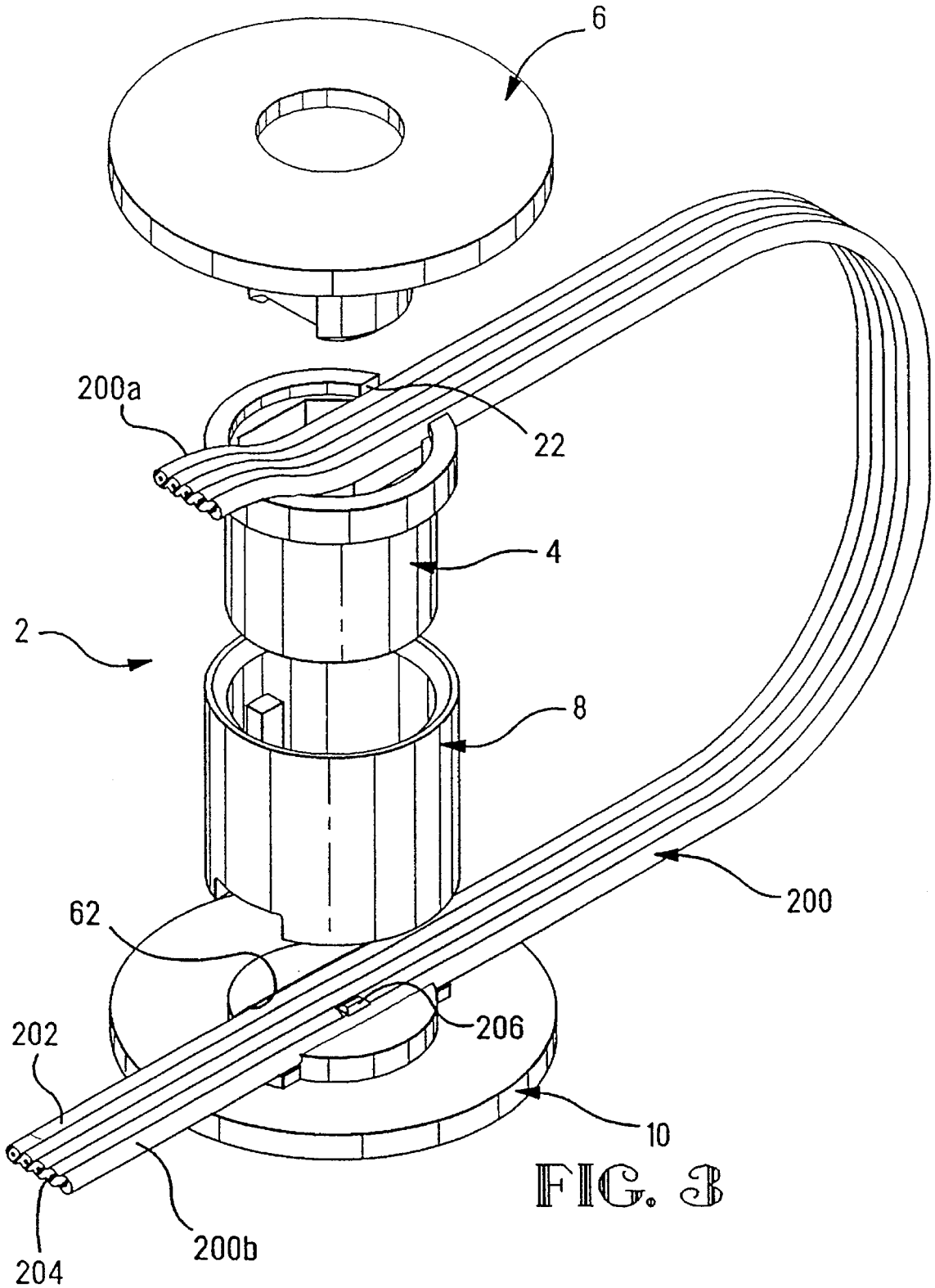
FIG. 3 is an isometric view similar to that of FIG. 1 showing the positioning of a cable to be terminated to the connector components.

A cable 200 is then positioned in the channel 62 as shown in FIG. 3. An opening 206 is positioned in the cable intermediate two conductors 204 and positioned over the peg 66 in the lower cover portion 10. The upper housing portion 8 can now be positioned over the cover portion 10 to bring the terminals 70, or 90 into electrical engagement with the conductors 204.

As mentioned above, one insulation displacement section 72, 74 extends below the lower surface 48 of the housing portion 8, while the other insulation displacement section extends above the surface 52 of the housing portion 8. The assembled portions 4 and 6 can now be pressed into the lower housing portion 8 by aligning slot 16 with the corresponding rib 44 and by pressing the two covers 61 and 26 together to effect final termination of the electrical terminals with the corresponding conductors. It should be appreciated that the opposite end of the cable 200*b* is in the so called "Daisy Chain Configuration" meaning that end 200*b* is not terminated but extends onwardly to other electrical connectors or to other electronic devices.

We claim:

1. An electrical connector assembly comprising a first connector and a second connector that is matable with the first connector, each connector being attachable to a cable having conductors therein, the first connector including terminals having a first wire connecting portion and a second wire connecting portion where the first wire connecting portion is engaged with one of the conductors when the first connector is attached to the cable and the second wire connecting portion is accessible, the second connector includes a front face through which the cable is accessible to the second wire connecting portion of the terminals when the second connector is mated with the first connector; the connector includes a housing portion and a pressing block receivable therein, the housing portion includes an outer surface having the front face with at least one aperture for receiving the corresponding second wire connecting portion and a bore wherein the pressing block is receivable therein, the pressing block having a channel for receiving the cable and moving the cable downward adjacent the aperture where the channel laterally positions the cable relative thereto such that the conductors correspond to respective apertures.

2. The electrical connector assembly of claim 1, further characterized in that the pressing block is telescopically received in the housing.

3. The electrical connector assembly of claim 2 further characterized in that the channel is disposed along an outer surface of the pressing block, the pressing block has sides and a lower face and where the channel has a portion along the lower face, where the lower face corresponds to the mating face when the pressing block is received in the housing portion.

4. The electrical connector assembly of claim 3, further characterized in that the housing portion and pressing block include complementary keying features oriented relative the apertures in the mating face and the channel such that the conductors in the cable will be properly positioned in the second connector.

5. The electrical connector assembly of claim 4, further characterized in that the first connector and the second connector include complementary keying features.

6. The electrical connector assembly of claim 1, further characterized in that the pressing block has a generally cylindrical form and the bore of the housing portion includes a cylindrical portion for correctly positioning the pressing block.

7. The electrical connector assembly of claim 6, further characterized in that the first connector includes a lower housing portion having a cylindrical shell with a lower rim having a channel extending thereaccross, and a lower cover part having a platform whereupon the cable is to be located, the lower housing portion fitted upon the lower cover part such that the channel corresponds to the platform, thereby captivating the cable therebetween.

8. The electrical connector assembly of claim 7, further characterized in that the lower housing portion includes a lower surface with a plurality of apertures wherein the terminals are positioned and the platform includes terminal receiving slots corresponding thereto.

9. The electrical connector assembly of claims 8, further characterized in that the platform and lower surface include complementary polarization members for positioning the cable and orienting the lower housing portion relative the lower cover part.

* * * * *